US009364735B2

(12) United States Patent
Beane

(10) Patent No.: US 9,364,735 B2
(45) Date of Patent: Jun. 14, 2016

(54) METHOD AND APPARATUS FOR AN EXERCISE SUPPORT DEVICE

(71) Applicant: Lawrence Beane, South Bend, IN (US)

(72) Inventor: Lawrence Beane, South Bend, IN (US)

( * ) Notice: Subject to any disclaimer, the term of this patent is extended or adjusted under 35 U.S.C. 154(b) by 0 days.

(21) Appl. No.: 14/329,055

(22) Filed: Jul. 11, 2014

(65) Prior Publication Data

US 2015/0080187 A1 Mar. 19, 2015

Related U.S. Application Data

(60) Provisional application No. 61/845,387, filed on Jul. 12, 2013.

(51) Int. Cl.

| | |
|---|---|
| ***A63B 69/00*** | (2006.01) |
| ***A63B 22/02*** | (2006.01) |
| ***A63B 22/06*** | (2006.01) |
| ***A63B 71/00*** | (2006.01) |
| ***A61H 23/00*** | (2006.01) |

(52) U.S. Cl.

CPC ..... *A63B 69/0064* (2013.01); *A61H 23/00* (2013.01); *A63B 22/02* (2013.01); *A63B 22/0664* (2013.01); *A63B 71/0009* (2013.01); *A63B 2209/10* (2013.01); *A63B 2210/50* (2013.01); *A63B 2225/09* (2013.01); *A63B 2225/64* (2013.01); *A63B 2225/66* (2013.01)

(58) Field of Classification Search

CPC ..... A63B 21/1419; A63B 69/0064; A63B 71/0009; A63B 3/00; A61H 3/008; A61H 2201/165–2201/1652

USPC ..... 482/69

See application file for complete search history.

(56) References Cited

U.S. PATENT DOCUMENTS

| | | | | |
|---|---|---|---|---|
| 4,881,492 | A | 11/1989 | Jones | |
| 5,137,272 | A * | 8/1992 | Wilkinson | 482/124 |
| 5,158,510 | A | 10/1992 | Lemire | |
| 5,176,597 | A | 1/1993 | Bryne | |
| 5,704,880 | A | 1/1998 | Amatulle | |
| 5,919,119 | A | 7/1999 | Bohmer | |
| 6,059,696 | A | 5/2000 | Bohmer | |
| 6,264,584 | B1 | 7/2001 | Bass | |
| 6,575,876 | B1 | 6/2003 | Phelps-McMillon | |
| 6,802,326 | B2 | 10/2004 | Kusama | |
| 6,899,660 | B1 * | 5/2005 | Chin et al. | 482/66 |
| 7,066,181 | B2 | 6/2006 | West | |
| 7,297,090 | B2 * | 11/2007 | Torres | 482/74 |
| 7,614,991 | B2 | 11/2009 | Fox | |
| 7,618,355 | B1 * | 11/2009 | Murdock | A63B 21/1419 482/110 |
| 8,043,197 | B2 * | 10/2011 | Hetrick | 482/91 |
| 8,257,232 | B2 | 9/2012 | Albert | |
| 2008/0070757 | A1 * | 3/2008 | Albert | A63B 69/0064 482/54 |
| 2009/0255531 | A1 | 10/2009 | Johnson | |
| 2010/0170546 | A1 * | 7/2010 | Popovic et al. | 135/67 |
| 2010/0326366 | A1 * | 12/2010 | Park | 119/700 |

* cited by examiner

*Primary Examiner* — Oren Ginsberg
*Assistant Examiner* — Jennifer M Deichl

(57) ABSTRACT

Apparatuses and methods that assist a user in utilizing an exercise machine. An exercise support device enables a user to exercise without having to hold on to the exercise machine while exercising. The exercise support device has a belt that can be worn by a user. In embodiments, the belt is connected to arm assemblies, which can be coupled to the side rails of an exercise machine. The exercise support device provides balance for a user of an exercise machine, which can enhance the quality of a user's exercise.

18 Claims, 6 Drawing Sheets

METHOD AND APPARATUS FOR AN EXERCISE SUPPORT DEVICE

CROSS-REFERENCE TO RELATED APPLICATIONS

This application claims the benefit of the filing date of U.S. provisional patent application Ser. No. 61/845,387, filed on Jul. 12, 2013, entitled "Method and Apparatus for an Exercise Support Device," the disclosure of which is incorporated herein by reference.

BACKGROUND

Generally, exercise machines, including but not limited to treadmills, stair steppers, and elliptical trainers, permit a user to exercise within a small, predetermined space and in a controlled manner. These devices allow a user to exercise indoors and have a number of benefits, including eliminating the effects of adverse weather conditions, allowing users to modify resistance and incline for more rigorous training, enhancing user privacy and security, and avoiding the impact of exercising on pavement, which many people find to be difficult on knees and other joints. However, exercise machines may prove difficult to use, particularly for individuals recovering from surgery, or for those with conditions that affect balance and motor control. Many exercise machines increase the risk of falling; for example, individuals with neurodegenerative diseases, such as Machado-Josephs disease, suffer from degraded muscle control and coordination and the movement of the machine exacerbates these issues. At the same time, exercise can be particularly beneficial for individuals with such physical conditions.

Many exercise machines incorporate side rails that allow a user to grip the machine for balance, reducing the likelihood that the user will fall. However, there is a temptation for a user to hold on to the side rails of the machine continually during exercise. Unfortunately, holding onto the side rails of an exercise machine during exercise is less beneficial than allowing the user's arms to move naturally during exercise. Typically, when holding on to the exercise machine users burn fewer calories, stress on various joints (e.g., hips, knees, and shoulders) is increased, and the body's balance is undermined while exercising. Unfortunately, many users need to hold on to one or more of the side rails of the exercise machine in order to maintain balance and stability to avoid injury.

BRIEF SUMMARY

The following presents a simplified summary in order to provide a basic understanding of some aspects of the claimed subject matter. This summary is not an extensive overview. It is not intended to either identify key or critical elements or to delineate the scope of the claimed subject matter. Its sole purpose is to present some concepts in a simplified form as a prelude to the more detailed description that is presented later.

The described apparatuses and methods assist users in safely utilizing exercise machines, including, but not limited to, treadmills. In embodiments, the support device includes a belt that can be attached to a user's torso, and two arm assemblies, each arm assembly connected to a side of the belt. In use, the user stands on the exercise machine with the belt in place on the user's torso and an arm assembly extending from each side of the user. Each of the arm assemblies can be attached to each one of the side or handrails that are typically provided with an exercise machine. In embodiments, the arm assemblies each include a rigid or semi-rigid arm, such that when the belt is positioned and the arm assemblies are attached to the belt and the exercise machine, the belt stabilizes the user on the exercise machine.

In an embodiment, an exercise support device comprises a belt capable of being sized for a user of the exercise machine, a first arm assembly connected to the belt, wherein the first arm assembly includes a first arm and is capable of being attached to a side rail of the exercise machine, and a second arm assembly connected to the belt, wherein the second arm assembly includes a second arm and is capable of being attached to a side rail of the exercise machine.

In other embodiments, an exercise support device comprises a belt capable of being sized for a user of the exercise machine and includes a breakaway mechanism that disengages the belt upon the application of a predetermined force, a first arm assembly connected to the belt, wherein the first arm assembly includes a first arm and is capable of being attached to a side rail of the exercise machine, and a second arm assembly connected to the belt, wherein the second arm assembly includes a second arm and is capable of being attached to a side rail of the exercise machine.

To the accomplishment of the foregoing and related ends, certain illustrative aspects of the claimed subject matter are described herein in connection with the following description and the annexed drawings. These aspects are indicative of various ways in which the subject matter may be practiced, all of which are intended to be within the scope of the claimed subject matter. Other advantages and novel features may become apparent from the following detailed description when considered in conjunction with the drawings.

BRIEF DESCRIPTION OF THE DRAWINGS

The systems, devices and methods may be better understood by referring to the following description in conjunction with the accompanying drawings, in which like numerals indicate like structural elements and features in various figures. The components in the figures are not necessarily to scale, and simply illustrate the principles of the systems, devices and methods. The accompanying drawings illustrate only possible embodiments of the systems, devices and methods and are therefore not to be considered limiting in scope.

DETAILED DESCRIPTION

Aspects of the system and methods are described below with reference to illustrative embodiments. The references to illustrative embodiments below are not made to limit the scope of the claimed subject matter. Instead, illustrative embodiments are used to aid in the description of various aspects of the systems and methods. The description, made by way of example and reference to illustrative reference is not meant to being limiting as regards any aspect of the claimed subject matter.

Figure 1:
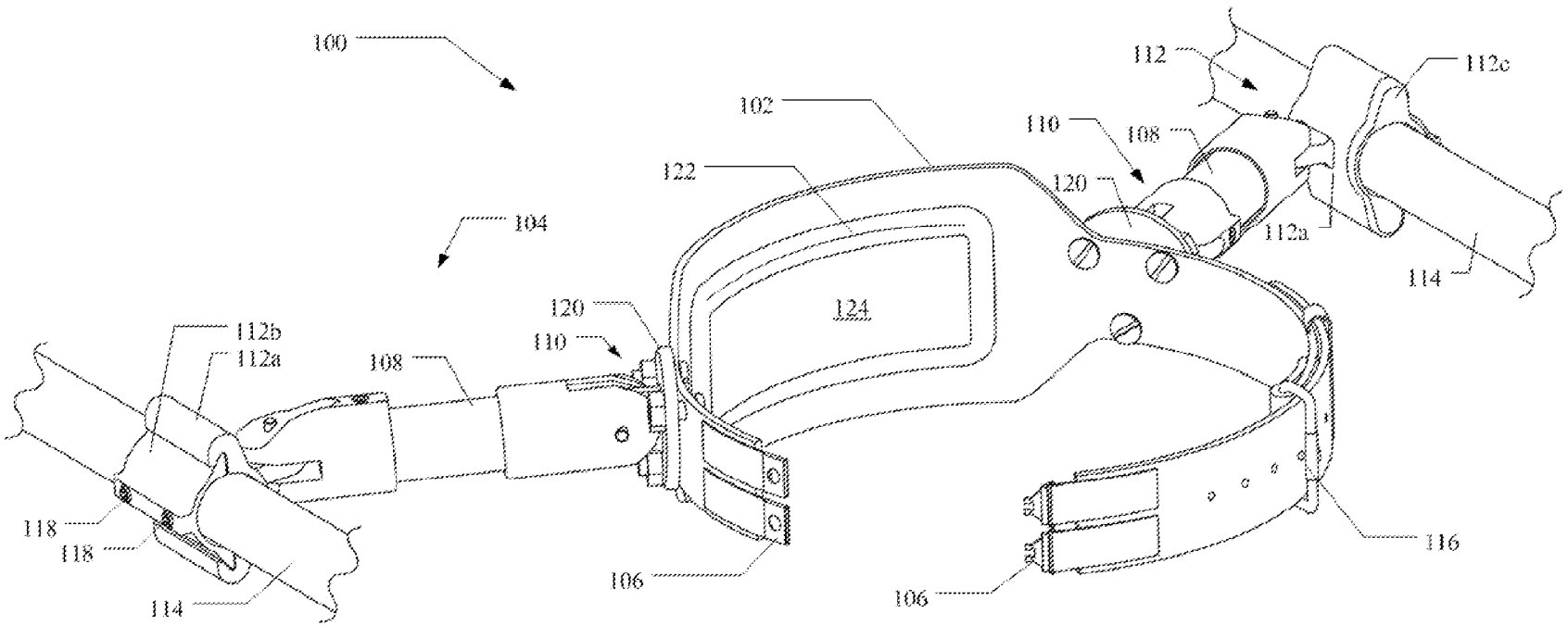
FIG. 1 depicts an embodiment of an exercise support device with the breakaway mechanism disengaged.
Figure 2:
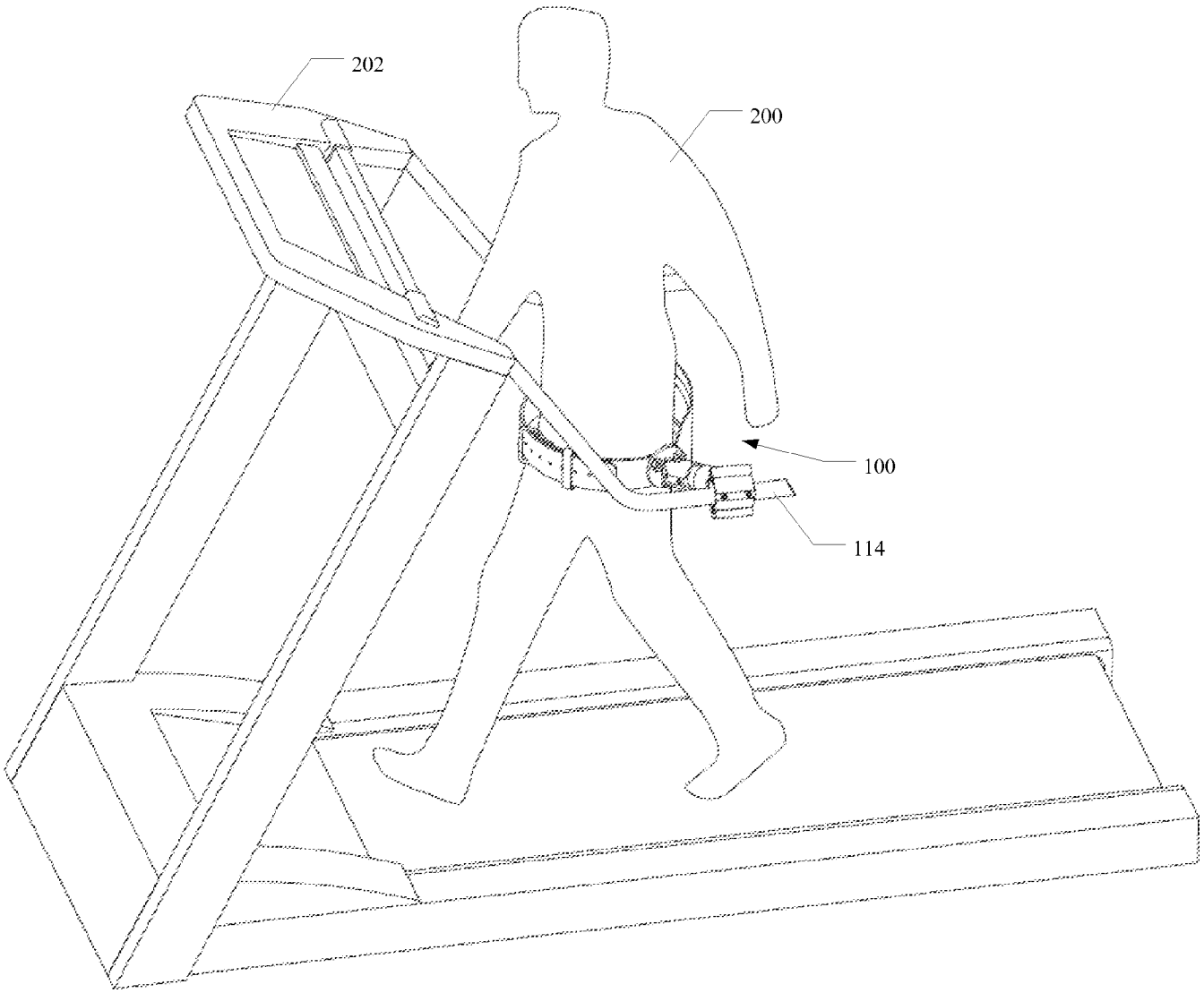
FIG. 2 depicts an embodiment of an exercise support device in use.

Referring to FIG. 1, an embodiment of an exercise support device 100 is illustrated. The exercise support device 100 assists a user 200 of an exercise machine 202, enhancing their stability and allowing them to obtain the benefits of the exercise. FIG. 2 illustrates a user 200 utilizing another embodiment of an exercise support device 100 on an exercise machine 202, shown here as a treadmill. Typical exercise machines 202 incorporate hand or side rails 114 that allow the user 200 to grip the machine 202 for stability. Such side rails 114 are typically parallel to the sagittal plane of the user 200 or the motion of the user 200 on the exercise machine 202. They can be designed to be in easy reach for the user 200 to grasp. Many users 200 find the movement of an exercise machine 202 disconcerting, and falls or other accidents during use of exercise machines 202 are common due to muscle weakness or other medical condition. Furthermore, exercise machines 202 are often used in physical rehabilitation, where the controlled motion of the machines may be particularly beneficial, but the potential for a fall may be increased. Problems with balance or other physical issues can make it even harder for those users to comfortably and safely utilize such machines, particularly treadmills.

Users 200 tend to hold the side rail 114 of exercise machines 202 for security, which reduces the benefits and workout obtained from the use of the exercise machine 202. When users 200 hold the side rails 114, they do not get the same upper body workout as they would have moving their arms freely, and burn fewer calories. In addition, use of side rails 114 may throw off the gait and posture of the user 200, particularly if the side rails 114 are not at an appropriate height for the individual user 200. By holding on to the side rails 114 the user 200 may come to rely on that support, rather than working to improve their balance and practicing unsupported walking.

Referring again to FIG. 1, the illustrated exercise support device 100 includes an adjustable belt 102 adapted to fit around the torso or waist of the user 200 of an exercise machine 202. The belt 102 is connected to side rails 114 of an exercise machine 202 by two arm assemblies 104 that stabilize the user 200 on the exercise machine 202, preventing the user 200 from straying too far from the appropriate position on the exercise machine 202. The exercise support device 100 assists a user 200 in utilizing an exercise machine 202 without holding the hand or side rails 114 of the exercise machine 202, enabling the user 200 to move more naturally. The arm assemblies 104 and the belt 102 limit the lateral and longitudinal movement of the user 200 in relation to the exercise machine 202, providing stabilization and preventing the user 200 from falling. At the same time, the exercise support device 100 allows the user 200 to move their arms freely and obtain the full benefit of the exercise.

In an embodiment of the exercise support device 100, the belt 102 includes a breakaway mechanism 106. As shown, the belt 102 includes a discontinuity, and the breakaway mechanism 106 bridges the discontinuity to form a generally continuous belt 102 when fastened around the torso of the user 200. Upon the application of a predetermined force, the breakaway mechanism 106 can release the user 200 from the belt 102. For example, should a user 200 trip or fall, the sudden force of the fall would cause the breakaway mechanism 106 to release, freeing the user 200 from the belt 102. This release prevents the user 200 from being held in place on the exercise machine 202 and potentially injured by the continued movement of the exercise machine 202 itself. In the embodiment shown in FIG. 2, a sudden fall would cause the breakaway mechanism 106 and belt 102 to release the user 200. This would allow the normal emergency stop features of the treadmill to engage, halting operation of the treadmill and avoid potentially suspending the user 200 on a moving treadmill. While shown on the front of the belt 102, the breakaway mechanism 106 can be positioned on the side or back of the belt 102, or anywhere that facilitates easy release from the belt 102.

In one embodiment, the breakaway mechanism 106 is comprised of one or more clips that automatically release if a predetermined force is applied to the belt 102. The breakaway mechanism 106 can also allow the user 200 to quickly free himself or herself of the exercise support device 100. In embodiments, the release of the breakaway mechanism 106, whether activated automatically or manually by the user 200, triggers the emergency features of the exercise machine 202. This can cause the exercise machine 202 to automatically stop when the breakaway mechanism 106 has been activated. In certain embodiments, the force required to release the breakaway mechanism 106 is greater than about 50 Newtons. In certain embodiments, the force required to release the breakaway mechanism 106 is greater than about 100 Newtons. In certain embodiments, the force required to release the breakaway mechanism 106 is greater than about 150 Newtons.

In embodiments, each arm assembly 104 includes a rigid or semi-rigid arm 108, providing security to the user 200 of the exercise machine 202 during exercise. The arms 108 are sufficiently rigid or stiff to guide the user 200 and—through the belt 102—assist in their balance on the exercise machine 202. For example, if a user 200 were to veer toward their right side during use, the rigid arms 102 would prevent the belt 102 from moving outside of the desired operational area of the exercise machine 202. Pressure exerted on the torso of the user 200 from the belt 102 would guide the user 200 to remain in that desired operational area. In embodiments, the arms 108 are extendable to accommodate users 200 of different heights and shapes, and to allow the exercise support device 100 to be used with a variety of exercise machine 202 designs.

Figure 4:
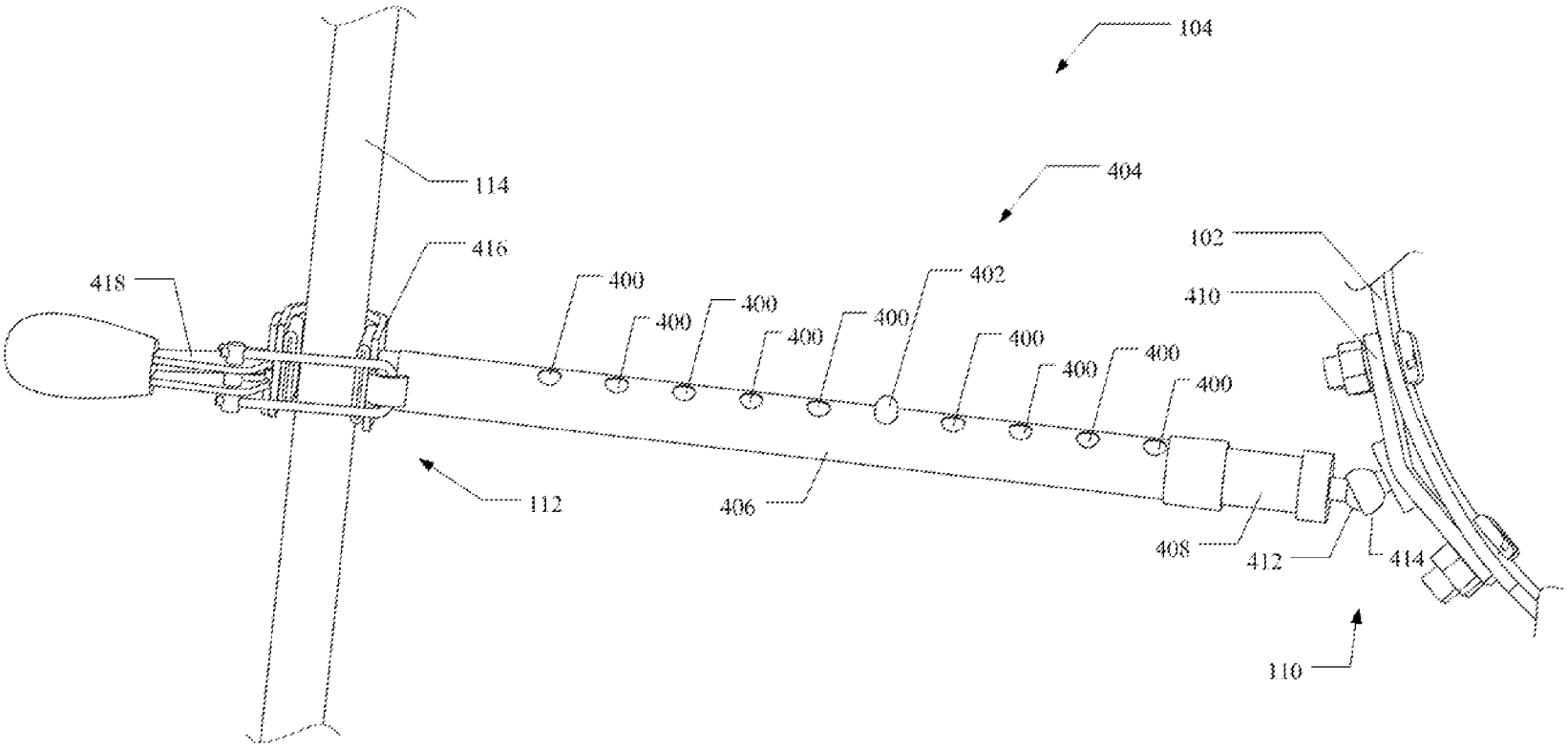
FIG. 4 depicts an embodiment of an arm assembly of an exercise support device.

In embodiments, the arms 108 are attached to the belt 102 via a belt connector 110. The belt connectors 110 can take a variety of shapes, including but not limited to, a hinged joint and a flange 120 secured to the belt (as shown in FIG. 1) or an angled bracket 410 (as shown in FIG. 4). In an embodiment, the arms 108 are at least 6 inches in length. In another embodiment, the arms 108 are at least 8 inches in length. In yet another embodiment, the arms 108 are at least 12 inches in length.

The arms 108 can be connected to a side rail 114 of an exercise machine 202 via a rail connector 112. As shown, the rail connector 112 can include a hinged joint. The rail connector 112 can take a variety of shapes to allow it to be securely attached to side rails 114 with different geometries, enabling use with a variety of types of exercise machines 202. As used herein, "geometry" refers to shape and dimensions of a structure. For example, the support device 100 can include multiple sets of rail connectors 112 where the particular rail connector 112 can be selected and connected to the support device 100 based upon the geometry of the side rail 114 of a particular exercise machine 202.

Securing the rail connector 112 to the side rails 114 provides support to the user 200, and minimizes undesired lateral movement for users 200 who struggle with balance or otherwise have difficulty exercising on exercise machines 202. In an embodiment, as illustrated in FIG. 1, the rail connectors 112 are slip-on rail fittings. The slip-on fitting has a female portion 112*a* and a male portion 112*b* that are seated on either side of the side rail 114 and are slid together so that the female and male portions 112*a*, 112*b* engage. A stop 112*c* on one of the fitting pieces 112*a*, 112*b* prevents the two pieces 112*a*,

112*b* from sliding completely past each other. Set screws 118 can be threaded through apertures in each portion of the fitting and tightened to engage the fitting with the side rail 114. Slip-on fittings can be obtained from Hollaender (Speed-Rail® line of fittings) or other manufacturers. Other suitable rail connectors 112 include, but are not limited to, collars, clamps, and brackets.

Figure 3:
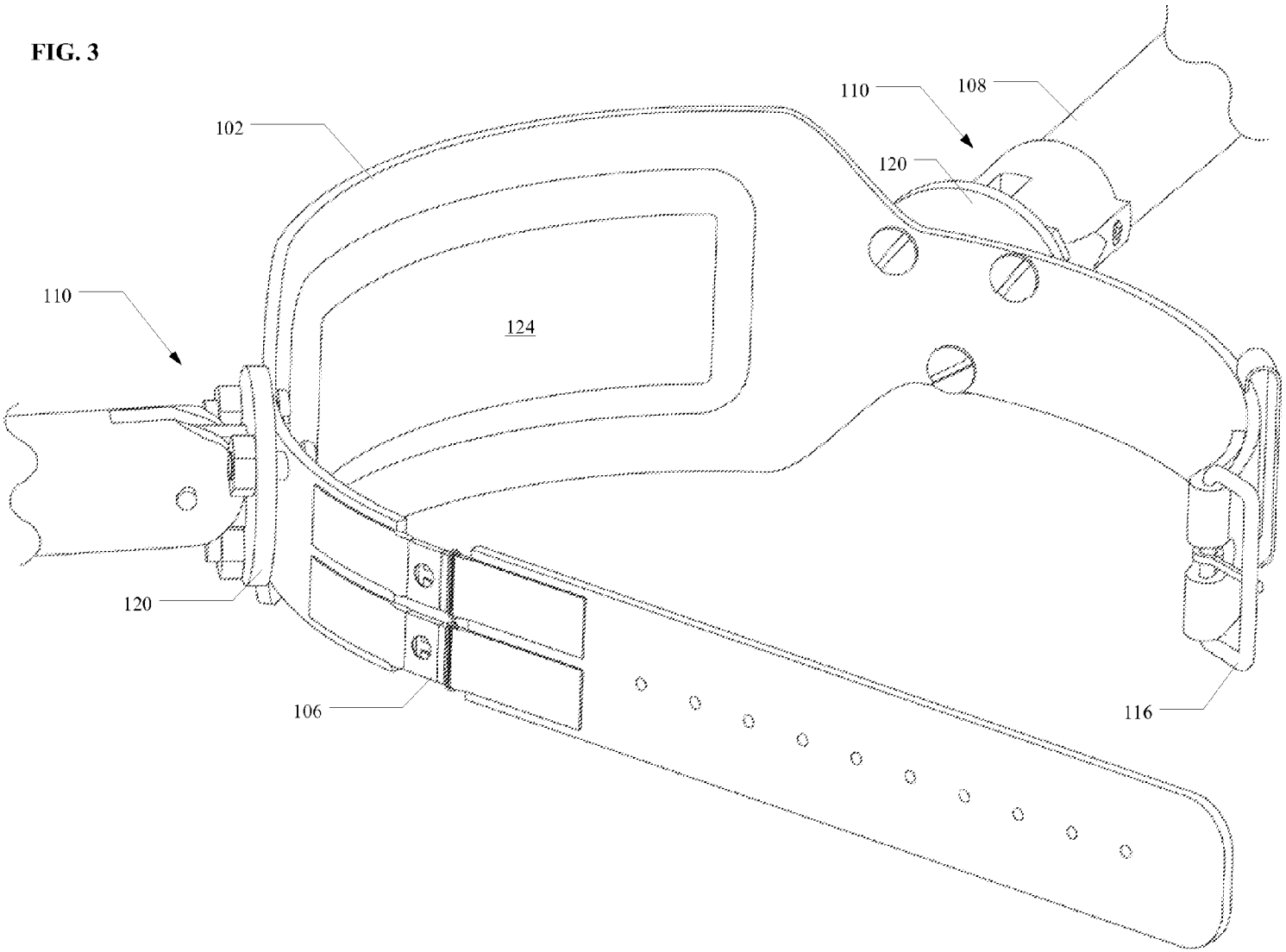
FIG. 3 depicts an embodiment of a belt of an exercise support device with the breakaway mechanism engaged.

Referring to FIG. 3, an embodiment of the belt 102 is illustrated. In one embodiment, the belt 102 may be secured and adjusted around the torso of a user 200 using a belt buckle 116 positioned on the front of the belt 102. As shown, the belt 102 includes a plurality of apertures such that one or more prongs of the belt buckle 116 are inserted through the apertures to adjust the length of the belt 102 for the individual user 200. In another embodiment, the belt 102 can be secured and adjusted by a hook-and-loop fastener. Any suitable method for adjusting belt length can be used, including, but not limited, to Velcro®.

In embodiments, the belt 102 is relatively wide, similar to a weight-lifting belt. Such width can provide greater support and increased stability for a user 200. In one embodiment, the back side of the belt 102 includes a support 124 that stabilizes the lower back of the user 200. In embodiments, the support 124 includes padding and increased belt width. The use of padding can provide a brace to relieve pressure from the back of the user 200. The belt 102 and support 124 may be constructed out of a variety of materials, including but not limited to leather, plastics and canvas. In embodiments, the belt 102 can be made using relatively stiff materials such as leather to provide greater support and stability to the user 200.

In embodiments, the back side of the belt 102 includes a pocket 122, shown in FIG. 1. In embodiments, the pocket 122 can secure an insert against the back of a user 200. Such inserts include, but are not limited to, hot packs, cold packs, padding, and vibrating massage devices. In certain embodiments, the pocket 122 can be securely held shut with a closure. Suitable closures include, but are not limited to, hook and loop fasteners, buttons, snaps, and zippers.

As shown, the belt 102 can include a breakaway mechanism 106 that automatically releases when sufficient force is applied. This breakaway mechanism 106 can work in conjunction with an emergency stop mechanism of an exercise machine 202 to enhance user 200 safety. For example, many treadmills contain an emergency stop mechanism that includes one or more clips attached to the user 200 or the user's clothing and an emergency stop on the machine, which may be a clip, button, or other device located on the treadmill. The emergency stop and the clip or clips attached to the user 200 are connected by a string or wire that is stretched between the user 200 and the machine when the user 200 is in position on the treadmill. If the treadmill user 200 is too far away from the emergency stop button, the string or wire will go taut and activate the emergency stop and halt the treadmill belt. In embodiments of the support device 100, if the user 200 falls, the breakaway mechanism 106 will release them from the belt 102. The fall of the user 200 will trigger the emergency release mechanism of the treadmill, preventing the treadmill from continuing to move after the user 200 has fallen.

The arm assemblies 104 can be attached to the belt 102 in a variety of locations, in accordance with the design of the exercise machine 202 to be used. In one embodiment, the arm assemblies 104 are located at the left and right sides of the belt 102 to be conveniently attached to the side rails 114 of an exercise machine 202. In embodiments, the arm assemblies 104 are detachable from the belt 102. Detaching the arm assemblies 104 from the belt 102 can facilitate storage and transportation of the device 100 by the user 200, shipment of the device 100 for distribution and retail purposes, as well as replacement of selected portions of the device 100. In other embodiments, the rail connector 112, arms 108, and belt connectors 110 are each detachable and interchangeable. The interchanging can be accomplished with any suitable releasable fastener including, but not limited to, screws, bolts and hooks.

In another embodiment, the belt 102 includes a quick release device (not shown) such as a hook-and-loop fastener, which may be released by pulling apart the fastener. In yet another embodiment of the quick release device, the release device comprises a side-release buckle, which may be released by applying a force to the sides of the buckle to separate the buckle mechanism. This quick-release mechanism can allow the user 200 to remove the belt 102 quickly without requiring the user 200 to resize the belt 102 once it has been adjusted to their torso. In an embodiment, the quick release device and the breakaway mechanism 106 are combined into a single mechanism.

Referring to FIG. 4, an embodiment of an arm assembly 104 is illustrated. In embodiments, the arm assembly 104 includes a belt connector 110 that allows for varying angles between the arm 108 and the belt 102. This flexibility, in conjunction with the length adjustment of the arm 108, allows the support device 100 to be used comfortably by individuals of varying heights and with a variety of exercise machines 202 with side rails 114. For example, the torso of a tall user 200 may be several inches above the height of the side rails 114. Accordingly, the belt 102 should sit on the torso of the user 200 several inches above the position of the rail connectors 112 on the side rails 114. Flexibility in the belt connector 110, allows for this height differential. As shown in FIG. 1, the flexibility can be achieved through hinged joints. Flexibility in the belt 102 and/or rail connectors 112 also accommodates for motion in the gait of the user 200 while the rigid arms 108 provide security.

In one embodiment, the belt connector 110 includes a ball and socket joint. For example, the socket portion 414 of the joint can be attached to the belt 102 and the ball portion 412 to the arm 108, allowing free rotation and varying angles between the arm 108 and belt 102. The socket 414 portion of the ball and socket joint can be attached to the belt 102 using pins, studs or any other suitable method. Similarly, the ball portion 412 of the ball and socket joint can be attached to the arm 108 using screws, pins or any other suitable method. Of course, the socket and ball portions 414, 412 of the joint could be reversed as well, attaching the ball portion 412 to the belt 102, and the socket portion 414 to the arm 108.

In embodiments, the arms 108 include an extension mechanism 404 for adjusting the length of the arms 108 to adapt to different sizes and heights of users 200 and exercise machines 202. In an embodiment, the arm 108 comprises one or more nested tubes 406, 408 and a pin mechanism that facilitates length adjustment. The tubes 406, 408 can be made from lightweight and fairly rigid material including, but not limited to, an aluminum alloy or plastic. Use of a lightweight material reduces weight during exercise and facilitates transport the device, while the rigidity helps support the user 200 and assists in maintaining user 200 balance and position on the exercise machine 202.

The pin mechanism can include a spring-loaded detent pin 402 that protrudes from the inner tube 408, and a series of apertures 400 that extend along all or a portion of the outer tube 406. This mechanism allows the user 200 to adjust the length of the arm 108 according to his or her needs and then lock the arm 108 length in place, such that the length of the arm 108 will be generally fixed and stable during exercise. In embodiments, the detent pin 402 is inserted into one of the apertures 400 in the outer tube 406 and a spring mechanism holds the detent pin 402 in place within the aperture 400. When a user 200 pushes on the detent pin 402, the pressure will cause the pin 402 to disengage from the selected aperture 400, allowing the nested tubes 406, 408 to slide or telescope. This telescoping movement allows the length of the arm 108 to be adjusted. When the desired length is achieved, the detent pin 402 is seated in the closest available aperture 400 and the length of the arm 108 is once again locked in position.

Any other mechanism that allows for extension or adjustment of the arm 108 can be used to implement length adjustable arms 108 for use with the support device 100. Other such mechanisms include, but are not limited to, nested tubes with a tube clamp such as is described in U.S. Pat. No. 4,596,484 (Lock for telescoping tubular support), or U.S. Pat. No. 144,997 (Improvement in hose-couplings); and internal locking mechanisms such as is described in U.S. Pat. No. 4,419,026 (Internal locking device for telescopic elements and method of making the same) or U.S. Pat. No. 1,115,057 (Expansible core).

Figure 5:
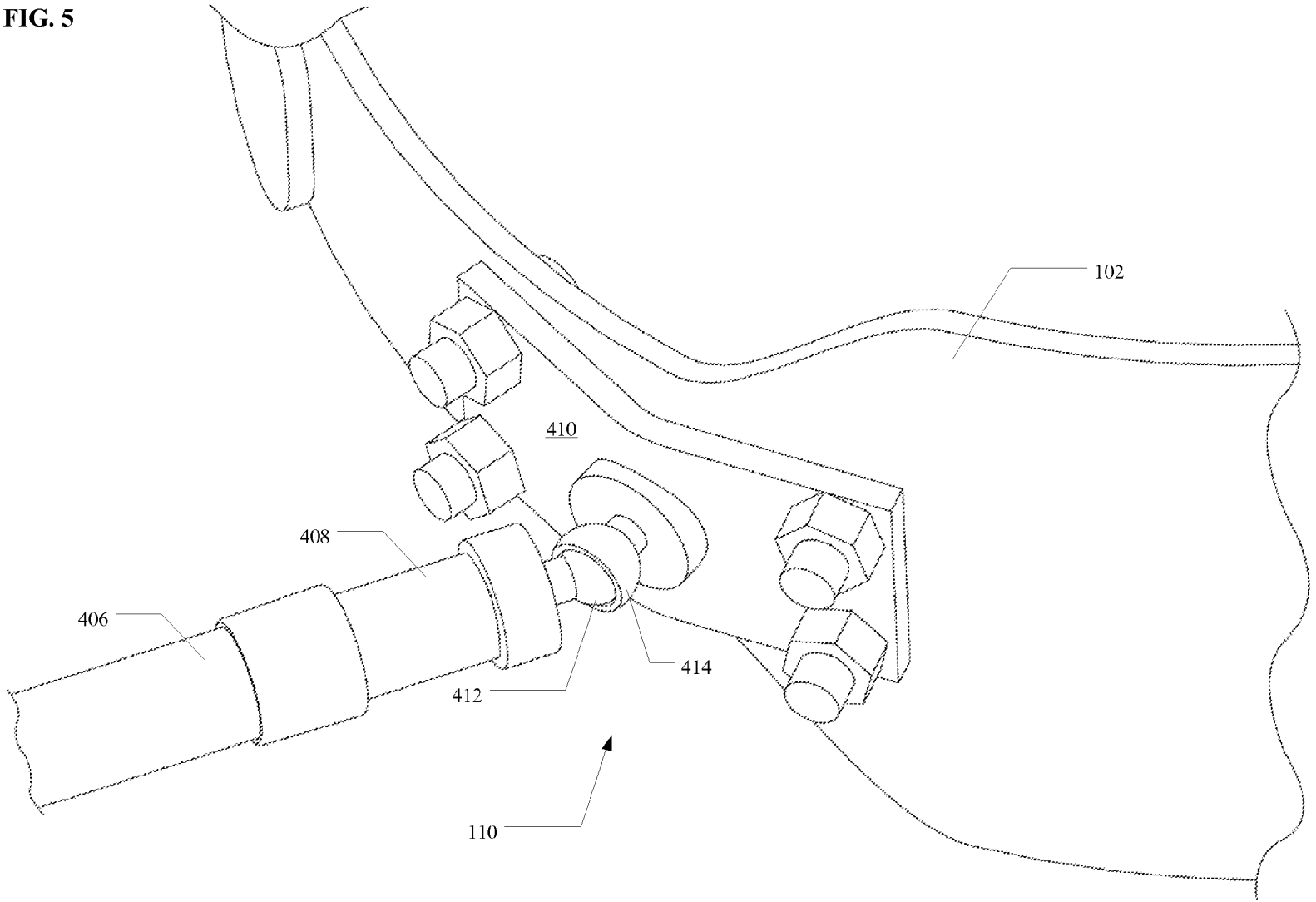
FIG. 5 depicts an embodiment of a belt connector of an exercise support device.

Turning now to FIG. 5, an embodiment of the belt connector 110 is illustrated. As shown, the belt connector 110 includes an angled bracket 410, secured to the belt 102 by one or more bolts, screws or other fasteners. The angled bracket 410 can provide stability to the connection of the arm assembly 104 to the belt 102, facilitating stabilization of the user 200 and increasing durability of the support device 100. Connected to the angled bracket 410 is the ball and socket joint, 412, 414, which gives flexibility to the support device 100, allowing for users 200 and exercise machines 202 of different heights. This flexibility also allows the support device 100 to move with the user 200 during exercise, giving some flexibility, while the rigid arm stabilizes the belt 102.

Figure 6:
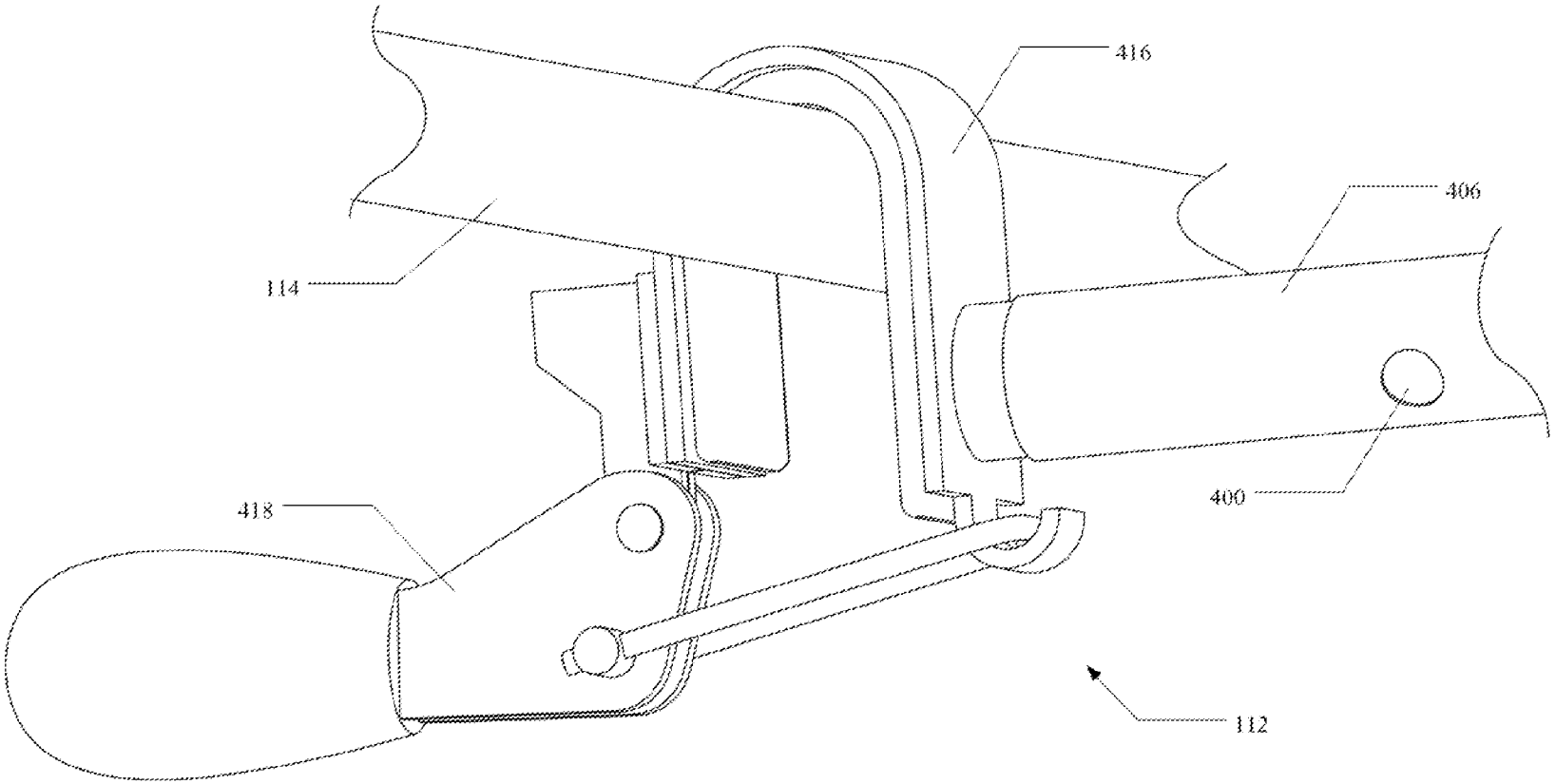
FIG. 6 depicts an embodiment of a rail connector of an exercise support device.

Referring to FIG. 6, an embodiment of a rail connector 112 is illustrated. In embodiments, the rail connector 112 includes a clamp that connects the arm assembly 104 to the side rails 114 of the exercise machine. In embodiments, the rail connector 112 fastens to the side rails of the exercise machine 202, securing the user 200 to the exercise machine 202 via the support device 100 while enabling the user 200 to exercise without holding on to the exercise machine 202. In embodiments, the rail connector 112 engages the side rail 114 so that it is generally fixed in position relative to the side rail 114 during exercise. Fixing the rail connectors 112 with respect to the side rails 114 stabilizes the support device 100 giving greater security to the user 200.

As shown in FIGS. 4 and 6, in an embodiment, the rail connector 112 is a U-shaped bracket 416 that can be engaged around a side rail 114 and a pull-action toggle clamp 418 can be used to close off the open end of the U-shaped bracket 416 and secure the rail connector 112 to the side rail 114. The interior of the U-shaped bracket 416 can be coated in rubber or any other material that enables the U-shaped bracket 416 to grip the side rails 114 and maintain a generally fixed position relative to the side rails 114. In further embodiments, the rail connectors 112 can be made in a variety of different shapes and dimensions to fasten to the side rails 114 of multiple types of exercise machine 202. In other embodiments, the rail connector 112 can also include ball and socket joint or other pivotable mechanisms, such as a hinge, length of cord, or strap. The pivotable mechanisms allow flexibility in the support device 100 and, as with the belt connector 110, allow for difference in height between the belt 102 and the side rails 114. As with the belt connector 110, in an embodiment with a ball and socket joint, the ball portion 412 of the joint could be attached to the arm 108, and the socket portion 414 of the joint to the rail connector 112. Of course, the socket and ball portions 414, 412 of the joint could be reversed as well, attaching the ball portion 412 to the rail connector 112, and the socket portion 414 to the arm 108. Flexible joints between the belt connectors 110, the arms 106, allow the arms 108 to be folded flat against the belt 102 for easier transportation and storage of the support device 100.

In embodiments, to utilize the exercise support device 100, the user 200 can secure the rail connectors 112 to side rails 114 of an exercise machine 202, and connect the arm assemblies 104 to the belt 102 by way of the belt connectors 110. A user 200 may put on the belt 102 by wrapping the belt around his or her waist and buckling the belt 102. The user 200 can adjust the length of the arms 108 as appropriate for the proper use of the exercise machine 202 and comfort of the user 200. The user 200 can use the exercise machine 202 by walking, running, using an elliptical trainer, using a stair stepping machine, or other method of exercise on an exercise machine 202.

In other embodiments, the user 200 can select the appropriate rail connectors 114 to attach to the side rails 112 of the desired exercise machine 202 and connect the selected rail connectors 112 to the arms 108, replacing an existing set of rail connectors 112 as needed.

What has been described above includes examples of aspects of the claimed subject matter. It is, of course, not possible to describe every conceivable combination of components or methodologies for purposes of describing the claimed subject matter, but one of ordinary skill in the art may recognize that many further combinations and permutations of the disclosed subject matter are possible. Accordingly, the disclosed subject matter is intended to embrace all such alterations, modifications and variations that fall within the spirit and scope of the appended claims. Furthermore, to the extent that the terms "includes," "has" or "having" or variations in form thereof are used in either the detailed description or the claims, such terms are intended to be inclusive in a manner similar to the term "comprising" as "comprising" is interpreted when employed as a transitional word in a claim.

What is claimed is:

1. An exercise support device configured for use with an exercise machine, the exercise support device comprising:

an adjustable belt that can be sized for a user of the exercise machine, wherein the exercise machine is selected from the group consisting of a treadmill, a stair-stepper, and an elliptical machine;

a first arm assembly that connects the adjustable belt to a first side rail of the exercise machine when the exercise support device is installed on the exercise machine; and a second arm assembly that connects the adjustable belt to a second side rail of the exercise machine when the exercise support device is installed on the exercise machine, wherein at least a portion of each of the first arm assembly and second arm assembly are substantially rigid and are configured to extend transversely in a gap between the adjustable belt and the first and second side rails to assist the user in maintaining stability when the exercise support device is installed on the exercise machine;

wherein the first arm assembly comprises a first belt connector attached to the belt, a first arm attached to the first belt connector, wherein the first arm is substantially rigid, and a first rail connector attached to the first arm: and wherein the second arm assembly comprises:

a second belt connector attached to the belt, a second arm attached to the second belt connector, wherein the second arm is substantially rigid, and a second rail connector attached to the second arm; and wherein the first rail connector is configured to connect to the first side rail and the second rail connector is configured to connect to the second side rail of the exercise machine.

2. The exercise support device of claim 1, wherein the first and second rail connectors are reversibly detachable from the first and second arms, respectively.

3. The exercise support device of claim 2, further comprising one or more customized rail connectors specific to a geometry of the first and second side rail, wherein the first and second rail connectors are replaceable with the one or more customized rail connectors.

4. The exercise support device of claim 1, wherein the first and second belt connectors are reversibly detachable from the first and second arms, respectively.

5. The exercise support device of claim 1, wherein the first and second rail connectors are fittings configured to secure to the first and second side rail, respectively, with fasteners.

6. The exercise support device of claim 1, wherein the first and second rail connectors are clamps that are configured to hold in a pressure fit engagement with the first and second side rails, respectively, when the support device is connected to the exercise machine.

7. The exercise support device of claim 1, wherein the first arm and the second arm each include an extension mechanism that controls a length of the first arm and the second arm.

8. The exercise support device of claim 7, wherein the first arm and the second arm each comprise an outer arm and an inner arm nested within the outer arm;

the outer arm includes a plurality of apertures spaced longitudinally along the outer arm, and the extension mechanism comprises a spring-loaded detent pin mounted in the inner arm, which when aligned with a selected aperture from the plurality of apertures, protrudes from the selected aperture and substantially secures the length of the first arm and the second arm.

9. The exercise support device of claim 1, wherein the first and second rail connectors each include a ball and socket joint.

10. The exercise support device of claim 1, wherein the first and second belt connectors each include a ball and socket joint.

11. The exercise support device of claim 1, further comprising:

a discontinuity in the adjustable belt; and a breakaway mechanism connecting the adjustable belt across the discontinuity, wherein the breakaway mechanism is configured to disengage upon application of a predetermined force to the adjustable belt, causing the adjustable belt to open, and freeing the user from the adjustable belt and the exercise support device.

12. The exercise support device of claim 11, wherein the predetermined force is greater than 50 Newtons.

13. The exercise support device of claim 1, wherein the adjustable belt comprises a support element that comprises a layer of padding.

14. The exercise support device of claim 1, wherein the adjustable belt comprises a support element that comprises a stiff brace for enhancing stability of the user.

15. The exercise support device of claim 1, wherein the adjustable belt comprises a pocket located on an interior of the belt, sized and shaped to hold a removable insert.

16. An exercise support device configured for use with an exercise machine, the exercise support device comprising:

a belt that can be sized for a user of the exercise machine, wherein the exercise machine is selected from the group consisting of a treadmill, a stair-stepper, and an elliptical machine: a first arm assembly that includes:

a first belt connector attached to the belt, a first arm that is substantially rigid and attached to the first belt connector, and a first rail connector attached to the first arm, wherein the first rail connector is configured to attach to a first side rail of the exercise machine and the first arm is configured to extend transversely between the belt and the first side rail when installed; and a second arm assembly that includes:

a second belt connector attached to the belt, a second arm that is substantially rigid and attached to the second belt connector, and a second rail connector attached to the second arm, wherein the second rail connector is configured to attach to a second side rail of the exercise machine and the second arm is configured to extend transversely between the belt and the second side rail when installed.

17. A method of using an exercise support device with an exercise machine, the method comprising the steps:

providing an exercise support device comprising:

a belt that can be sized for a user of the exercise machine wherein the exercise machine is selected from the group consisting of a treadmill a stair-stepper, and an elliptical machine:

a first arm assembly that includes a first belt connector attached to the belt, a first arm attached to the first belt connector, wherein the first arm is substantially rigid, and a first rail connector attached to the first arm, wherein the first rail connector attaches to a first side rail of the exercise machine; and a second arm assembly that includes a second belt connector attached to the belt, a second arm attached to the second belt connector, wherein the second arm is substantially rigid, and a second rail connector attached to the second arm, wherein the second rail connector attaches to a second side rail of the exercise machine; attaching the first rail connector to the first side rail of the exercise machine, wherein the first arm extends transversely in a gap between the belt and the first side rail;

attaching the second rail connector to the second side rail of the exercise machine, wherein the second arm extends transversely in the gap between the belt and the second side rail;

securing the belt about the waist of the user;

adjusting a length of the first arm;

adjusting a length of the second arm; and using the exercise machine.

18. The method of using an exercise support device with an exercise machine of claim 17, further comprising the steps:

detaching the first rail connector from the first arm; detaching the second rail connector from the second arm;

selecting a different first rail connector based at least in part on a geometry of the first side rail;

selecting a different second rail connector based at least in part on a geometry of second side rail;

attaching the different first rail connector to the first arm; and attaching the different second rail connector to the second arm.

* * * * *